US005911866A

United States Patent [19]

Oshima et al.

[11] Patent Number: 5,911,866

[45] Date of Patent: Jun. 15, 1999

[54] ACID TIN-SILVER ALLOY ELECTROPLATING BATH AND METHOD FOR ELECTROPLATING TIN-SILVER ALLOY

[75] Inventors: Katsuhide Oshima; Satoshi Yuasa, both of Tokyo, Japan

[73] Assignee: Dipsol Chemicals Co., Ltd., Tokyo, Japan

[21] Appl. No.: 08/921,081

[22] Filed: Aug. 29, 1997

[30] Foreign Application Priority Data

Jan. 20, 1997 [JP] Japan ..... 9-007555

[51] Int. Cl.[6] ..... C25D 3/46; C23C 18/00

[52] U.S. Cl. ..... 205/253; 205/254; 106/1.23; 106/1.26

[58] Field of Search ..... 205/253, 254; 106/1.23, 1.26

[56] References Cited

U.S. PATENT DOCUMENTS 5,514,261 5/1996 Herklotz et al. ..... 205/253
5,549,810 8/1996 Herklotz et al. ..... 205/259
5,601,696 2/1997 Asakawa ..... 205/263

FOREIGN PATENT DOCUMENTS 0 666 342 8/1995 European Pat. Off. .
7-252684 10/1995 Japan .
8-13185 1/1996 Japan .

*Primary Examiner*—Kishor Mayekar
*Attorney, Agent, or Firm*—Oblon, Spivak, McClelland, Maier & Neustadt, P.C.

[57] ABSTRACT

The invention relates to an acid tin-silver alloy plating bath which comprises tin ions, silver ions, one compound selected from the group consisting of aromatic thiol compounds and aromatic sulfide compounds, substantially non-cyanide and a balance of water, the pH of the bath being not higher than 2. According to this acid bath, tin and silver can be kept dissolved in the bath in a stable state for a long period of time even at a high temperature and a predetermined plating capacity is kept for a long period of time even though the bath is free from cyanide.

20 Claims, No Drawings

ACID TIN-SILVER ALLOY ELECTROPLATING BATH AND METHOD FOR ELECTROPLATING TIN-SILVER ALLOY

FIELD OF THE INVENTION

The present invention relates to an acid, tin-silver alloy plating bath substantially non-cyanide and a method for electroplating Tin-Silver alloy onto a substrate.

BACKGROUND OF THE INVENTION

As tin-silver alloy plating baths used for forming a tin-silver alloy plating film on a metal substrate or the like, an alkaline cyanide bath has been known.

However, since the bath contains the poisonous cyanide, the bath has problems that the bath per se has an extremely high toxicity which necessitates a special care in the handling and a special treatment of the waste water and that the working environment is polluted.

On the other hand, known non-cyanide acid baths, for example, include an alkanesulfonic acid or alkanolsulfonic acid bath, and mercaptoalkanecarboxylic acid and/or mercaptoalkanesulfonic acid as disclosed in Japanese Patent Unexamined Published Application (hereinafter referred to as "J. P. KOKAI") Nos. Hei 7-252684 and Hei 8-13185.

However, in such an acid bath, it was impossible to form a stable solution by dissolving silver which is an indispensable component for forming the tin-silver alloy together with tin. Namely, silver was insolubilized to form a black or brown precipitate immediately after or within 24 hours after the preparation of the plating bath. It was thus difficult to maintain the concentration of the components in the bath.

After intensive investigations, the present applicant had developed an acid bath which was an alkanesulfonic acid and/or sulfamic acid bath containing a thioamide compound and a thiol compound. Although silver is not precipitated or insolubilized immediately after the preparation of the plating bath or in 24 hours thereafter, the plating bath has a problem that the thioamide compounds and the thiol compounds such as mercaptosuccinic acid and mercaptolactic acid exert a harmful influence on the plating properties when the plating bath is left to stand or kept being used for a long period of time.

When the acid bath is left to stand at a high temperature, silver is insolubilized to form the black or brown precipitate within 24 hours like in the acid baths disclosed in the above-described J. P. KOKAI Nos. Hei 7-252684 and 8-13185 and thus, it is difficult to keep the concentration of each component in the bath.

SUMMARY OF THE INVENTION

A primary object of the present invention is to provide a tin-silver alloy plating bath in which tin and silver can be kept dissolved therein in a stable state for a long period of time even at a high temperature and which is capable of keeping a predetermined plating capacity for a long period of time even though the bath is free from a cyanide compound.

Another object of the present invention is to provide an effective method for electroplating Tin-Silver alloy onto a substrate.

These and other objects of the present invention will be apparent from the following description and Examples.

The present invention has been completed on the basis of a finding that a specific aromatic sulfur compound is effective in dissolving both tin and silver in a substantially non-cyanide acid bath to form a stable solution.

Namely, the present invention provides an acid tin-silver alloy plating bath which comprises tin ions, silver ions, one compound selected from the group consisting of aromatic thiol compounds and aromatic sulfide compounds, substantially non-cyanide compounds and a balance of water, the pH of the bath being not higher than 2.

The present invention further provides a method for electroplating Tin-Silver alloy on a substrate which comprises the steps of immersing the substrate as the cathode and a plate of a tin-silver alloy or tin plate as the anode in an acid tin-silver alloy plating bath which comprises tin ions, silver ions, one compound selected from the group consisting of aromatic thiol compounds and aromatic sulfide compounds, substantially non-cyanide(no cyanide) and a balance of water, the pH of the bath being not higher than 2, and charging electric current of about 0.5 to 50 A thereto for about 0.5 to 10 minutes to form onto the substrate a tin-silver alloy film comprising 20 to 99% by weight of tin and 80 to 1% by weight of silver and having a thickness of 1 to 30 $\mu$m.

DESCRIPTION OF THE PREFERRED EMBODIMENTS

The tin compounds usable in the present invention are not particularly limited so far as they are capable of releasing tin ions in the acid bath. They include, for example, stannous oxide, stannous sulfate, tin chlorides, tin sulfides, tin iodides, tin citrates, tin oxalates and stannous acetate. They are used either singly or in the form of a mixture of two or more of them. Although the tin ion concentration in the plating bath is not particularly limited, it is preferably 2 to 80 g/l, more preferably 10 to 40 g/l (in terms of tin).

The silver compounds usable in the present invention are not particularly limited so far as they are capable of releasing silver ions in the acid bath. They include, for example, silver oxides, silver sulfates, silver chlorides and silver nitrates. They are used either singly or in the form of a mixture of two or more of them. Although the silver ion concentration in the plating bath is not particularly limited, it is preferably 0.01 to 80 g/l, more preferably 0.1 to 50 g/l (in terms of silver).

The aromatic thiol compounds and aromatic sulfide compounds used in the present invention are preferably those having 6 to 14 carbon atoms. In particular, at least one of the compounds having the following structures is preferably used:

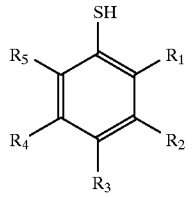

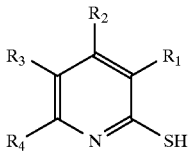

-continued

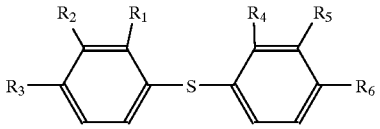

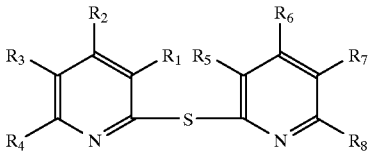

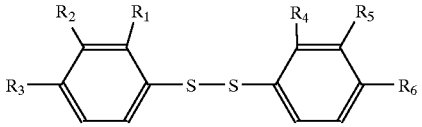

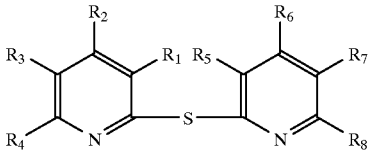

wherein $R_1$ to $R_8$ each represent a hydrogen atom, lower alkyl group (preferably having 1 to 3 carbon atoms), hydroxyl group, nitro group, amino group or thiol group.

More specifically, the aromatic thiol compounds usable in the present invention include, for example, thiophenol, mercaptophenol, thiocresol, nitrothiophenol, thiosalicylic acid, aminothiophenol, benzenedithiophenol and mercaptopyridine. They are used either singly or in the form of a mixture of two or more of them.

The aromatic sulfides are preferably aromatic mono- or disulfide compounds such as 4,4-thiodiphenol, 4,4-aminodiphenyl sulfide, thiobisthiophenol, 2,2-diaminodiphenyl disulfide, 2,2-dithiodibenzoic acid, ditolyl disulfide and 2,2-dipyridyl disulfide. They are used either singly or in the form of a mixture of two or more of them.

The aromatic thiol compounds and aromatic sulfides are more preferably those having $NH_2$ group in the substituent in the structure thereof or those having a pyridine ring in the structure thereof.

Either or both of the aromatic thiol compound or/and aromatic sulfide compound is usable in the present invention. Further a mixture of two or more of the aromatic thiol compounds or aromatic sulfide compounds is also usable. These compounds are capable of imparting a gloss to the resultant deposit, too.

The amount of each of the aromatic thiol compound and aromatic sulfide compound used in the present invention is not particularly limited so far as both tin and silver dissolved in the bath can be kept stable. It is preferably 0.1 to 200 g/l, more preferably 0.2 to 50 g/l.

An acid substance can be incorporated into the tin-silver alloy plating bath in order to control the pH of the bath on acidic side. The acid substances are preferably alkanesulfonic acids having 1 to 3 carbon atoms such as methanesulfonic acid, ethanesulfonic acid and hydroxypropanesulfonic acid; benzenesulfonic acids and phenolsulfonic acids having 6 or 7 carbon atoms such as sulfosalicylic acid and cresolsulfonic acid; alkanolsulfonic acids such as isopropanolsulfonic acid; and sulfamic acid. These acids are usable either singly or in the form of a mixture of two or more of them. Although the acid concentration in the plating bath is not particularly limited so far as tin and silver are soluble therein, it is preferably 10 to 500 g/l, more preferably 50 to 400 g/l. In particular, the acid concentration in the plating bath is controlled so that the pH of the bath can be kept not higher than 2, preferably not higher than 1.

The plating bath of the present invention can comprise the above-described indispensable components and the balance of water and, if necessary, additives such as a brightening agent and lubricating agent. The brightening agent may be any of those used for brightening tin and silver such as nonionic surfactants, anionic surfactants, synthetic polymers (e. g. PVP, PEG and PVA), amines (e. g. hexamethylenetetramine and triethanolamine), ketones (e. g. benzalacetone and acetophenone), aliphatic aldehydes (e. g. formalin and valeric aldehyde), aromatic aldehydes (e. g. salicylaldehyde and vanillin) and metal compounds containing Sb, Se, Cu, In, Zn, Ca, Ba or the like. These compounds are usable either singly or in the form of a mixture of two or more of them. The amount of the brightening agent is preferably 0.5 to 50 g/l, more preferably 0.2 to 30 g/l.

Antioxidants for tin are also usable. They include hydroxyphenyl compounds such as phenol, catechol, pyrogallol and hydroquinone; L-ascorbic acid; and sorbitol.

The acid tin-silver alloy plating bath of the present invention are usable for plating various substrates such as iron or copper substrates by an ordinary method to form the tin-silver alloy deposit. In particular, the substrate as the cathode and a plate of a tin-silver alloy or tin plate as the anode are immersed in the tin-silver alloy plating bath and then electric current of about 0.5 to 50 A is sent for about 0.5 to 10 minutes to form a tin-silver alloy film comprising 20 to 99% by weight of tin and 80 to 1% by weight of silver and having a thickness of 1 to 30 $\mu$m.

The tin-silver alloy plating bath of the present invention has an advantage that it has only a low toxicity and a high safety because it is of a non-cyanide type unlike an ordinary alkaline cyanide bath. In addition, although silver easily forms insoluble salts with various substances, the tin-silver alloy plating bath of the present invention can be kept stable for a long period of time without changing the plating function thereof. Another advantage of this plating bath is that since it does not necessitate any special treatment of the waste water, the waste water treatment cost is low.

When the tin-silver alloy plating bath of the present invention is used as an electroplating bath, a thin film having a thickness of 1 to 30 $\mu$m is obtained unlike a film formed by a hot dipping technique. Thus, according to the present invention, even precision parts can be plated and a high workability can be attained advantageously.

The following Examples will further illustrate the present invention.

EXAMPLE 1

An acid tin-silver alloy plating bath comprising the following components and the balance of water was prepared (pH: not higher than 1):

| | |
|---|---|
| SnO | 30 g/l |
| methanesulfonic acid | 350 g/l |
| $Ag_2O$ | 2 g/l |
| 2-aminobenzenethiol | 20 g/l |

EXAMPLE 2

An acid tin-silver alloy plating bath comprising the following components and the balance of water was prepared (pH: not higher than 1):

| | |
|---|---|
| SnO | 30 g/l |
| methanesulfonic acid | 350 g/l |
| $Ag_2O$ | 1 g/l |
| 2,2-dipyridyl disulfide | 5 g/l |

EXAMPLE 3

An acid tin-silver alloy plating bath comprising the following components and the balance of water was prepared (pH: not higher than 1):

| | |
|---|---|
| SnO | 30 g/l |
| methanesulfonic acid | 1150 g/l |
| $Ag_2O$ | 1 g/l |
| 2,2-dipyridyl disulfide | 5 g/l |
| nonionic surfactant (SEDORAN FF-180; a product of Sanyo Chemical Industries, Ltd.) | 4 g/l |
| benzalacetone | 1.5 g/l |

EXAMPLE 4

An acid tin-silver alloy plating bath comprising the following components and the balance of water was prepared (pH: not higher than 1):

| | |
|---|---|
| SnO | 10 g/l |
| hydroxypropanesulfonic acid | 150 g/l |
| $Ag_2O$ | 10 g/l |
| 2-aminobenzenethiol | 5 g/l |
| nonionic surfactant (EPAN 450; a product of Dai-ichi Kogyo Seiyaku Co., Ltd.) | 5 g/l |
| 35% formalin | 10 g/l |
| triethanolamine | 5 g/l |
| potassium antimonyl tartrate | 0.1 g/l |

EXAMPLE 5

An acid tin-silver alloy plating bath comprising the following components and the balance of water was prepared (pH: not higher than 1):

| | |
|---|---|
| SnO | 30 g/l |
| isopropanolsulfonic acid | 250 g/l |
| $Ag_2O$ | 3 g/l |
| 2-aminobenzenethiol | 5 g/l |
| nonionic surfactant (EPAN 450; a product of Dai-ichi Kogyo Seiyaku Co., Ltd.) | 6 g/l |
| piperonal | 0.1 g/l |

COMPARATIVE EXAMPLE 1

An acid tin-silver alloy plating bath comprising the following components and the balance of water was prepared (pH: not higher than 1):

| | |
|---|---|
| SnO | 30 g/l |
| methanesulfonic acid | 150 g/l |
| $Ag_2O$ | 2 g/l |

COMPARATIVE EXAMPLE 2

An acid tin-silver alloy plating bath comprising the following components and the balance of water was prepared (pH: not higher than 1):

| | |
|---|---|
| SnO | 30 g/l |
| isopropanolsulfonic acid | 150 g/l |
| $Ag_2O$ | 5 g/l |

COMPARATIVE EXAMPLE 3

An acid tin-silver alloy plating bath comprising the following components and the balance of water was prepared (pH: 3.2):

| | |
|---|---|
| $SnCl_4.5H_2O$ | 30 g/l |
| $AgNO_3$ | 63 g/l |
| thiomalic acid | 90 g/l |
| potassium citrate | 26 g/l |

KOH and NaOH were used in a weight ratio of 1:1 for controlling pH.

COMPARATIVE EXAMPLE 4

An acid tin-silver alloy plating bath comprising the following components and the balance of water was prepared (pH: not higher than 1):

| | |
|---|---|
| SnO | 30 g/l |
| methanesulfonic acid | 150 g/l |
| $Ag_2O$ | 2 g/l |
| thiourea | 3 g/l |

COMPARATIVE EXAMPLE 5

An acid tin-silver alloy plating bath comprising the following components and the balance of water was prepared (pH: not higher than 1):

| | |
|---|---|
| SnO | 30 g/l |
| methanesulfonic acid | 150 g/l |
| $Ag_2O$ | 1 g/l |
| thiourea | 3 g/l |
| nonionic surfactant (SUNMORL BN-13D; a product of Nikka Kagaku) | 4 g/l |
| hexamethylenetetramine | 4 g/l |
| benzalacetone | 1.5 g/l |
| potassium antimonyl tartrate | 0.1 g/l |

The plating baths prepared in Examples 1 to 5 and Comparative Examples 1 to 5 were left to stand at room temperature. The formation of the precipitate in the plating bath was macroscopically observed and the silver concentration was analyzed by the atomic absorptiometry 4 hours, 10 days, 30 days and 120 days after.

The results are summarized in Table 1.

TABLE 1

| | Precipitation | | | | Silver conc. in bath (g/l) | | | |
|---|---|---|---|---|---|---|---|---|
| | a. | b. | c. | d. | a. | b. | c. | d. |
| Ex. 1 | ○ | ○ | ○ | ○ | 1.86 | 1.86 | 1.85 | 1.86 |
| Ex. 2 | ○ | ○ | ○ | ○ | 0.93 | 0.91 | 0.93 | 0.92 |
| Ex. 3 | ○ | ○ | ○ | ○ | 0.93 | 0.93 | 0.91 | 0.92 |
| Ex. 4 | ○ | ○ | ○ | ○ | 27.9 | 27.7 | 27.8 | 27.8 |
| Ex. 5 | ○ | ○ | ○ | ○ | 2.78 | 2.78 | 2.79 | 2.78 |
| Comp. Ex. 1 | x | x | x | x | 0.00 | 0.00 | 0.00 | 0.00 |
| Comp. Ex. 2 | x | x | x | x | 0.00 | 0.00 | 0.00 | 0.00 |
| Comp. Ex. 3 | ○ | x | x | x | 40.4 | 8.64 | 0.00 | 0.00 |
| Comp. Ex. 4 | ○ | ○ | ○ | ○ | 1.86 | 1.85 | 1.86 | 1.86 |
| Comp. Ex. 5 | ○ | ○ | ○ | ○ | 0.93 | 0.92 | 0.92 | 0.93 |

○: no precipitation
x: precipitation
a. 4 hours after the preparation of the plating bath:
b. 10 days after the preparation of the plating bath:
c. 30 days after the preparation of the plating bath:
d. 120 days after the preparation of the plating bath:

The plating baths prepared in Examples 1 to 5 and Comparative Examples 4 and 5 were left to stand at 60° C. The formation of the precipitate in the plating bath was macroscopically observed and the silver concentration was analyzed by the atomic absorptiometry 4 hours, 10 days, 30 days and 120 days after.

The results are summarized in Table 2.

TABLE 2

| | Precipitation | | | | Silver conc. in bath (g/l) | | | |
|---|---|---|---|---|---|---|---|---|
| | a. | b. | c. | d. | a. | b. | c. | d. |
| Ex. 1 | ○ | ○ | ○ | ○ | 1.86 | 1.86 | 1.85 | 1.86 |
| Ex. 2 | ○ | ○ | ○ | ○ | 0.93 | 0.91 | 0.93 | 0.92 |
| Ex. 3 | ○ | ○ | ○ | ○ | 0.93 | 0.93 | 0.91 | 0.92 |
| Ex. 4 | ○ | ○ | ○ | ○ | 27.9 | 27.7 | 27.8 | 27.8 |
| Ex. 5 | ○ | ○ | ○ | ○ | 2.78 | 2.78 | 2.79 | 2.78 |
| Comp. Ex. 4 | x | x | x | x | 0.74 | 0.00 | 0.00 | 0.00 |
| Comp. Ex. 5 | x | x | x | x | 0.36 | 0.00 | 0.00 | 0.00 |

○: no precipitation
x: precipitation
a. 4 hours after the preparation of the plating bath:
b. 10 days after the preparation of the plating bath:
c. 30 days after the preparation of the plating bath:
d. 120 days after the preparation of the plating bath:

The plating baths prepared in Examples 1 to 5 and Comparative Examples 4 and 5 were left to stand at room temperature. The Hull cell tests were conducted under the conditions shown below 4 hours, 10 days, 30 days and 120 days after.

Test conditions:

bath temperature: 25° C.
anodic plate: tin plate
cathodic plate: polished steel plate
electric current: 3 A
plating time: 10 minutes.

In the plating bath prepared in Comparative Example 4, crude precipitates were formed in a high-current density part and the relative amount of alloyed silver was increased in the tin-silver alloy with time, while no change in the appearance of the deposit or in the proportion of the tin to silver in the alloy with time was observed when the plating bath prepared in any of Examples 1 to 5 was used. When the plating bath prepared in Comparative Example 5 was used, the gloss and smoothness of the deposit were deteriorated and the relative amount of alloyed silver was decreased in the tin-silver alloy with time.

The relative amount of alloyed silver in the deposit was determined by the atomic absorptiometry in parts 1, 5 and 9 cm distant from the high-current density side of the Hull cell test panel. The results of the analysis are shown in Table 3.

TABLE 3

| | Alloyed silver in deposit (wt. %) Distance from high current | | | | | |
|---|---|---|---|---|---|---|
| density side | 1 cm | 5 cm | 9 cm | 1 cm | 5 cm | 9 cm |
| | 4 hours after | | | 10 days after | | |
| Ex. 1 | 8.6 | 6.4 | 2.5 | 8.5 | 6.6 | 2.4 |
| Ex. 2 | 4.2 | 3.4 | 1.8 | 4.3 | 3.3 | 1.6 |
| Ex. 3 | 3.5 | 3.3 | 2.9 | 3.6 | 3.4 | 3.0 |
| Ex. 4 | 36.7 | 24.5 | 18.8 | 37.8 | 25.4 | 18.5 |
| Ex. 5 | 12.6 | 9.8 | 7.2 | 12.8 | 9.6 | 7.1 |
| Comp. Ex. 4 | 7.8 | 5.5 | 2.8 | 8.5 | 6.4 | 3.1 |
| Comp. Ex. 5 | 5.6 | 3.4 | 1.9 | 4.4 | 2.1 | 1.1 |
| | 30 days after | | | 120 days after | | |
| Ex. 1 | 8.7 | 6.3 | 2.5 | 8.6 | 6.4 | 2.6 |
| Ex. 2 | 4.0 | 3.3 | 1.6 | 4.2 | 3.4 | 1.7 |
| Ex. 3 | 3.5 | 3.4 | 2.9 | 3.5 | 3.4 | 2.9 |
| Ex. 4 | 36.5 | 24.9 | 18.5 | 36.8 | 24.7 | 18.7 |
| Ex. 5 | 12.7 | 9.7 | 7.3 | 12.6 | 9.8 | 7.3 |
| Comp. Ex. 4 | 9.8 | 6.9 | 3.7 | 9.7 | 7.0 | 3.8 |
| Comp. Ex. 5 | 3.6 | 1.6 | 0.9 | 3.4 | 1.4 | 0.8 |

What is claimed is:

1. An acid tin-silver alloy plating bath which comprises tin ions, silver ions, one compound selected from the group consisting of aromatic thiol compounds and aromatic sulfide compounds, substantially non-cyanide and a balance of water, the pH of the bath being not higher than 2.

2. The acid plating bath of claim 1, wherein the aromatic sulfide compounds are aromatic mono- or disulfide compounds.

3. The acid plating bath of claim 1, wherein the aromatic thiol compounds and aromatic sulfide compounds have 6 to 14 carbon atoms.

4. The acid plating bath of claim 1, wherein the aromatic thiol compounds and aromatic sulfide compounds are selected from the group consisting of compounds having the following structures:

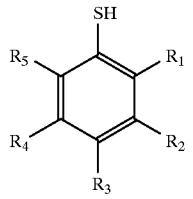

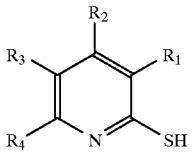

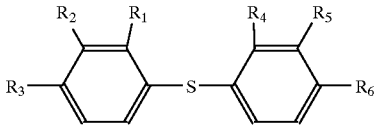

-continued

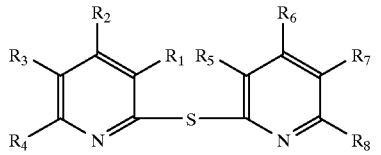

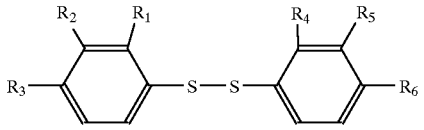

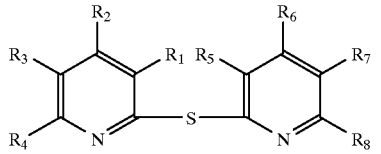

wherein $R_1$ to $R_8$ each represent a hydrogen atom, lower alkyl group having one to three carbon atoms, hydroxyl group, nitro group, amino group or thiol group.

5. The acid plating bath of claim 1, wherein an amount of the aromatic thiol compounds and aromatic sulfide compounds is 0.1 to 200 g/l.

6. The acid plating bath of claim 1, wherein an amount of the tin ions is 2 to 80 g/l calculated as Sn.

7. The acid plating bath of claim 1, wherein an amount of the silver ions is 0.01 to 80 g/l calculated as Ag.

8. The acid plating bath of claim 1, which further contains one acid selected from the group consisting of alkanesulfonic acids, alkanolsulfonic acids and sulfamic acids.

9. The acid plating bath of claim 8, which an amount of the acid 10 to 500 g/l.

10. An acid tin-silver alloy plating bath which comprises 2 to 80 g/l of tin ion calculated as Sn, 0.01 to 80 g/l of silver ions calculated as Ag, 0.1 to 200 g/l of one compound having 6 to 14 carbon atoms selected from the group consisting of aromatic thiol compounds and aromatic sulfide compounds, substantially non-cyanide compounds and a balance of water, the pH of the bath being not higher than 2.

11. The acid plating bath of claim 10, wherein the aromatic thiol compounds and aromatic sulfide compounds are selected from the group consisting of compounds having the following structures:

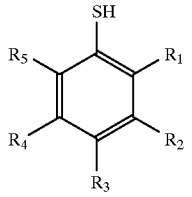

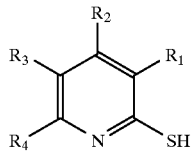

-continued

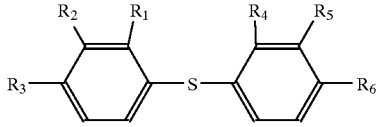

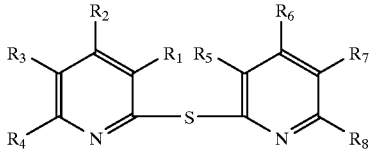

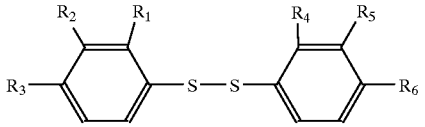

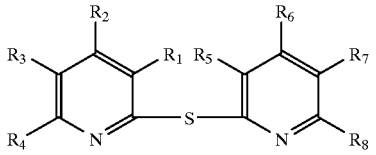

wherein $R_1$ to $R_8$ each represent a hydrogen atom, lower alkyl group having one to three carbon atoms, hydroxyl group, nitro group, amino group or thiol group.

12. The acid plating bath of claim 10, which further contains 10 to 500 g/l of one acid selected from the group consisting of alkanesulfonic acids, alkanolsulfonic acids and sulfamic acids.

13. A method for electroplating tin-silver alloy on a substrate which comprises the steps of immersing the substrate as the cathode and a plate of a tin-silver alloy or tin plate as the anode in an acid tin-silver alloy plating bath which comprises tin ions, silver ions, one compound selected from the group consisting of aromatic thiol compounds and aromatic sulfide compounds, substantially non-cyanide compounds and a balance of water, the pH of the bath being not higher than 2, and charging electric current of about 0.5 to 50 A thereto for about 0.5 to 10 minutes to form onto the substrate a tin-silver alloy film comprising 20 to 99% by weight of tin and 80 to 1% by weight of silver and having a thickness of 1 to 30 $\mu$m.

14. The method of claim 13, wherein the aromatic thiol compounds and aromatic sulfide compounds have 6 to 14 carbon atoms.

15. The method of claim 13, wherein the aromatic thiol compounds and aromatic sulfide compounds are selected from the group consisting of compounds having the following structures:

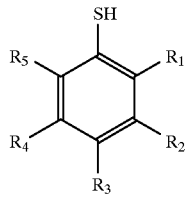

-continued

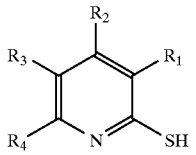

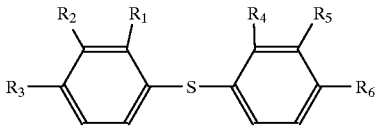

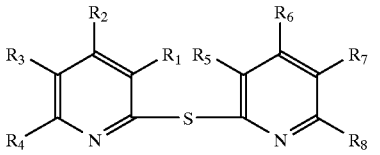

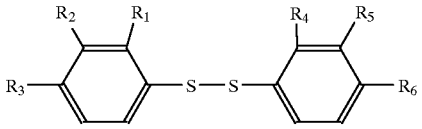

-continued

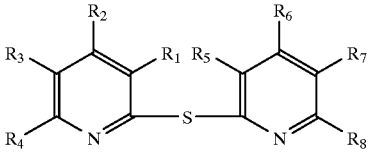

wherein $R_1$ to $R_8$ each represent a hydrogen atom, lower alkyl group having one to three carbon atoms, hydroxyl group, nitro group, amino group or thiol group.

16. The method of claim 13, wherein an amount of the aromatic thiol compounds and aromatic sulfide compounds is 0.1 to 200 g/l.

17. The method of claim 13, wherein an amount of the tin ions is 2 to 80 g/l calculated as Sn.

18. The method of claim 13, wherein an amount of the silver ions is 0.01 to 80 g/l calculated as Ag.

19. The method of claim 13, which the bath further contains one acid selected from the group consisting of alkanesulfonic acids, alkanolsulfonic acids and sulfamic acids.

20. The method of claim 19, which an amount of the acid 10 to 500 g/l.

* * * * *